US010804638B1

(12) United States Patent
Li et al.

(10) Patent No.: US 10,804,638 B1
(45) Date of Patent: Oct. 13, 2020

(54) SAFETY SHIELD ASSEMBLY FOR POWER RECEPTACLE AND RELATED POWER RECEPTACLE

(71) Applicant: Chengli Li, Suzhou, Jiangsu (CN)

(72) Inventors: Chengli Li, Suzhou (CN); Xiaoming Zhang, Suzhou (CN)

(73) Assignee: Chengli Li, Suzhou (CN)

( * ) Notice: Subject to any disclaimer, the term of this patent is extended or adjusted under 35 U.S.C. 154(b) by 0 days.

(21) Appl. No.: 16/696,019

(22) Filed: Nov. 26, 2019

Related U.S. Application Data

(63) Continuation-in-part of application No. 16/446,107, filed on Jun. 19, 2019, now Pat. No. 10,770,823.

(30) Foreign Application Priority Data

| | | |
|---|---|---|
| May 23, 2019 | (CN) | 2019 1 0432262 |
| May 23, 2019 | (CN) | 2019 2 0746032 U |
| Oct. 25, 2019 | (CN) | 2019 1 1022191 |
| Oct. 25, 2019 | (CN) | 2019 2 1806311 U |

(51) Int. Cl.
*H01R 13/44* (2006.01)
*H01R 13/453* (2006.01)
*H01R 13/52* (2006.01)

(52) U.S. Cl.
CPC ..... *H01R 13/4534* (2013.01); *H01R 13/5213* (2013.01)

(58) Field of Classification Search
CPC ..... H01R 13/4534; H01R 13/4536; H01R 13/5213; H01R 25/006
USPC ..... 439/135–139
See application file for complete search history.

(56) References Cited

U.S. PATENT DOCUMENTS

| | | | |
|---|---|---|---|
| 6,767,229 | B1 | 7/2004 | Wang |
| 7,312,963 | B1 | 12/2007 | Radosavljevic et al. |
| 8,187,012 | B1 | 5/2012 | Baldwin et al. |
| 2016/0013577 | A1 | 1/2016 | Diakomis et al. |
| 2016/0301154 | A1 | 10/2016 | Lee et al. |

*Primary Examiner* — Khiem M Nguyen
(74) *Attorney, Agent, or Firm* — Chen Yoshimura LLP

(57) ABSTRACT

A safety shield assembly for a power receptacle and a power receptacle incorporating the same. The assembly includes a frame, and a sliding block and a resilient member disposed in the frame. The frame has multiple openings corresponding to multiple socket holes of the power receptacle, a position limiting member, and a balancing support member. The sliding block has a sliding block base, two protection ramps disposed in the base and spaced apart, and two metal reinforcement members joined to and formed integrally with the two protection ramps to cover their inclined surfaces. When a power plug is inserted into the socket holes, two prongs of the plug push against the reinforcement members on the protection ramps and the sliding block slides away. When an object is inserted into only one socket hole, the balancing support member and position limiting member cooperate to prevent the sliding block from sliding.

20 Claims, 7 Drawing Sheets

SAFETY SHIELD ASSEMBLY FOR POWER RECEPTACLE AND RELATED POWER RECEPTACLE

BACKGROUND OF THE INVENTION

Field of the Invention

This invention generally relates to home appliances, and in particular, it relates to a safety shield assembly for a power receptacle and a power receptacle having such a safety shield assembly.

Description of Related Art

Power receptacles are widely used in homes and public places. Conventional power receptacles often have exposed socket holes. With the increased safety awareness, many power receptables are equipped with safety shield assemblies over the socket holes to prevent unintended conductive object from being accidentally inserted into the socket holes which can cause electrical shock. Current power receptables with safety shield assemblies still have certain shortcomings. For example, current safety shield assemblies are formed of plastic materials, and the surface of the shields is prone to damage due to frequent use (plugging and unplugging of plugs). The damages may cause the sliding parts of the safety shield assemblies to become non-smooth or even stuck during operation, which interferes with the plugging action. Thus, there is a need for power receptacles with safety shields that have a simple structure and can lower cost and increase production sufficiency.

SUMMARY

To solve the problem of damage due to frequent use, some safety shield assemblies are provided with metal blocks to reduce the wear of the plastic parts. However, such metal blocks are prone to falling off, making the products unreliable. Moreover, if the metal block falls into the power receptacle, it can cause safety problems.

To solve the above problems and improve safety, in one aspect, the present invention provide a safety shield assembly for a power receptacle, which includes: a frame, a sliding block disposed in the frame, and a resilient member disposed in the frame. The sliding block includes: a sliding block base; a first protection ramp disposed in the sliding block base; a second protection ramp disposed in the sliding block base and spaced apart from the first protection ramp; and at least one reinforcement member, joined to and formed integrally with the first protection ramp or the second protection ramp. The frame includes a bottom panel with at least two openings corresponding to at least two socket holes of the power receptacle, a position limiting member configured to abut the sliding block, and a balancing support member, wherein when the resilient member is in its initial state, it urges the sliding block to a closed position where the sliding block covers the at least two openings. When an inserted object pushes on only one of the first protection ramp and the second protection ramp, the position limiting member limits a sliding motion of the sliding block, and wherein when two inserted objects simultaneously push on the first protection ramp and the second protection ramp, the sliding block is balanced on the balancing support member and slides along the frame to expose the at least two openings.

In one embodiment, the sliding block further includes: a retaining groove located in the sliding block base under the second protection ramp, configured to receive one end of the resilient member; and at least one processing slot formed in the first protection ramp or the second protection ramp and aligned with a through slot of the reinforcement member.

In one embodiment, the retaining groove includes a working surface configured to drive deformation of the resilient member, and a locking surface configured to keep the resilient member in a deformed state.

In one embodiment, the sliding block includes: two reinforcement members respectively joined to the first protection ramp and the second protection ramp; and a processing slot formed in each of the first protection ramp and the second protection ramp and aligned with a through slot of the respective one of the two reinforcement members.

In one embodiment, the at least one reinforcement member is formed of a metal material or another hard, wear-resistant material.

In one embodiment, the at least one reinforcement member covers an inclined area of the first protection ramp or the second protection ramp that faces away from the bottom panel of the frame.

In one embodiment, the first protection ramp and the second protection ramp have different sizes.

In one embodiment, the frame further includes a retaining member configured to retain the resilient member, the retaining member including either a protruding shaft that protrudes from the inner bottom surface or an inner side surface of the frame, or a receding slot on the inner bottom surface or the inner side surface of the frame.

In another aspect, the present invention provides a safety shield assembly for a power receptacle, which includes: a frame, having a bottom panel configured to define at least two openings; a sliding block disposed in the frame, and a resilient member disposed in the frame. The sliding block includes: a sliding block base; a first protection ramp disposed in the sliding block base; a second protection ramp disposed in the sliding block base and spaced apart from the first protection ramp, wherein the first and second protection ramps face away from the bottom panel of the frame and are located at positions corresponding to the at least two openings of the frame when the sliding block is at the closed position; and at least one reinforcement member, joined to and integrally formed with the first protection ramp or the second protection ramp. The resilient member is configured to urge the sliding block toward a closed position, wherein when in the closed position, the sliding block covers the at least two openings of the frame. The frame further includes a balancing support member located between the at least two openings and configured to pivotally support the sliding block, wherein the sliding block is configured to change from a first pivoting state to a second pivoting state in response to an external force exerted on only one of the first protection ramp and second protection ramp, and to remain in the first pivoting state in response to forces simultaneously exerted on both of the first protection ramp and second protection ramp, and wherein the frame further includes a position limiting member configured to restrict a sliding motion of the sliding block when the sliding block is at the closed position and in the second pivoting state, and to not restrict the sliding motion of the sliding block when the sliding block is in the first pivoting state.

In another aspect, the present invention provides a power receptacle, which includes at least one safety shield assembly described above; a body, including an upper cover and a base connected together; and at least two plug receiving plates disposed in the body, wherein the safety shield assembly is disposed between the upper cover and the at least two plug receiving plates.

In one embodiment, the power receptacle further includes a leakage current protection assembly.

The safety shield assembly provided by embodiments of the present invention has a simple structure, is safe and reliable, convenient to use, and can be compatible with various types of power receptacles. Because of the simple structure, the device can be easily assembled in large scale production with high efficiency. The device is low cost and has wide applications.

BRIEF DESCRIPTION OF THE DRAWINGS

Preferred embodiments of the present invention are described with reference to the drawings. The drawings are not necessarily to scale. In these drawings, like reference symbols represent like features.

DETAILED DESCRIPTION OF PREFERRED EMBODIMENTS

The disclosure of commonly-owned, co-pending application U.S. patent application Ser. No. 16/446,107, filed Jun. 19, 20190, is incorporated herein by reference in its entirety.

A power receptacle according to preferred embodiments of the present is described below. It should be understood that these descriptions describe embodiments of the present invention but do not limit the scope of the invention. When describing the various components, directional terms such as "up," "down," "top," "bottom" etc. are not absolute but are relative. These terms may correspond to the views in the various illustrations, and can change when the views or the relative positions of the components change.

A main technical problem solved by embodiments of this invention is to prevent damage to the safety shield assembly due to frequent use (plugging and unplugging of plugs), and to therefore solve the problem of the sliding parts of the safety shield assemblies becoming non-smooth or stuck during operation, and to improve safety.

To solve these problems, in the safety shield assembly for a power receptacle according to an embodiment of the present invention, a reinforcement member is provided, which is formed integrally with the protection ramp of the sliding block of the safety shield assembly. The reinforcement member is formed of a metal material or another hard, wear-resistant material. Compared to conventional technology, the safety shield assembly and the power receptacle employing the same according to embodiments of the present invention can reduce plastic wear due to frequent plugging and unplugging of the power plug. Meanwhile, because the reinforcement member is formed integrally with the protection ramp, it will not fall off due to frequent use, thereby enhancing safety.

Figure 1A:
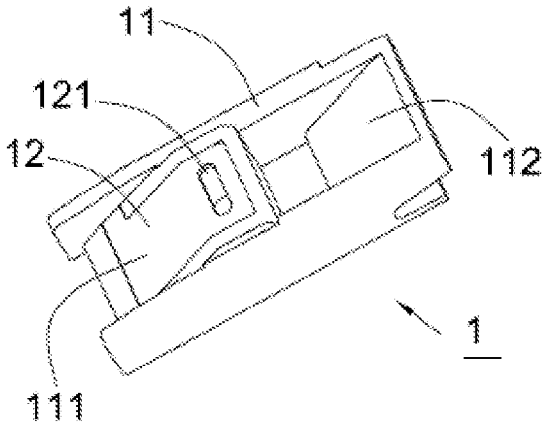
FIGS. 1A-1C schematically illustrate the structure of a safety shield assembly for a power receptacle according to an embodiment of the present invention.
Figure 1B:
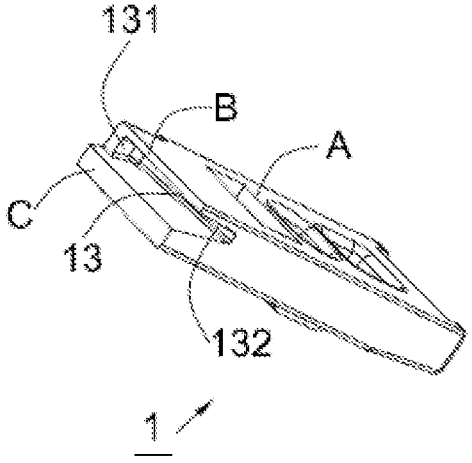
Figure 1C:
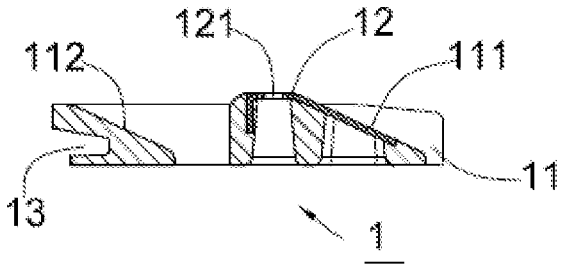
Figure 2:
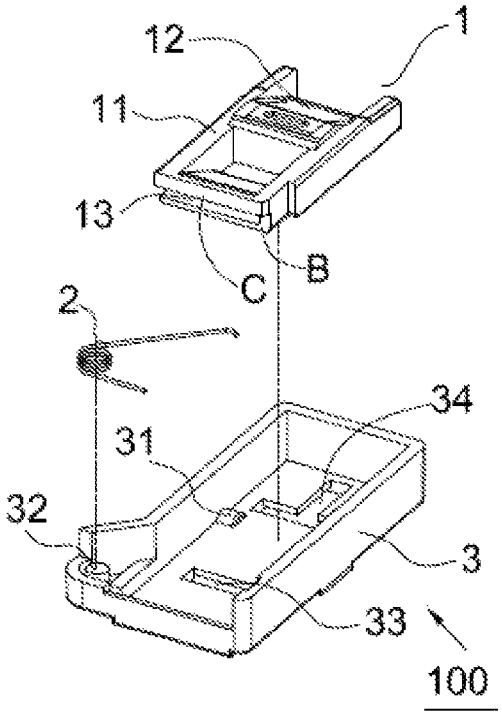
FIG. 2 is an exploded view of the safety shield assembly.

Refer to FIG. 2, which illustrate a safety shield assembly 100 for a power receptacle according to an embodiment of the present invention. The safety shield assembly 100 includes a frame or base 3, and a sliding block 1 and resilient member 2 disposed within the frame 3. The frame 3 has a bottom panel and a side wall, and is preferably open at the top. The bottom panel is configured to have multiple openings corresponding to the shape of the socket holes of the receptacle, such as I shaped openings or T shaped openings. For example, FIG. 2 illustrates an I shaped opening 33 and a T shaped opening 34, which are suitable for various standard power receptacles. The frame 3 is further configured to have a position limiting member 35 and a balancing support member 31 that can abut the sliding block 1. As shown in FIGS. 1A-1C, the sliding block 1 includes: sliding block base 11, a first protection ramp 111, a second protection ramp 112, and at least one reinforcement member 12 for a protection ramp. When an object is attempted to be inserted but is only pushing on one of the first protection ramp 111 and second protection ramp 112, due to the effect of the balancing support member 31, the sliding block 1 becomes tilted and the position limiting member 35 prevents the sliding block 1 from sliding. When an object is attempted to be inserted by pushing simultaneously on both the first protection ramp 111 and second protection ramp 112, due to the effect of the balancing support member 31, the sliding block 1 remains untilted and is able to slide along the frame 3 to expose the socket holes. In this connection, note that an opening is provided near the lower end of the second protection ramp 112 to allow the prong to pass through, and the sliding block 1 ends at the lower end of the first protection ramp 111 which allows the other prong to pass through. Preferably, the resilient member 2 is configured such that it urges the sliding block 1 toward a closed position where the sliding block 1 covers the socket holes. This way, the safety shield assembly can effectively prevent an object from being inserted or prevent the plug prongs from being incorrectly inserted. Moreover, in the protecting state (i.e., when the sliding block covers the socket holes), the safety shield assembly can isolate components inside the power receptacle from the environment, thereby protecting them from undesirable environmental factors (such as dust, moisture, etc.).

In this embodiment, a reinforcement member 12 is provided on either the first protection ramp 111 or the second protection ramp 112, or two reinforcement members are provided on the two protection ramps respectively. The first and/or second protection ramp is formed of a plastic material, and a processing slot (a through slot or a groove) 121 is formed on the respective protection ramp, so that when forming the respective protection ramp by thermoplastic processing (e.g. injection molding), the processing slot 121 is used to integrally form the reinforcement member 12 with the respective protection ramp, so as to form the reinforcement member 12 integrally with the respective protection ramp. More specifically, when forming the first or second protection ramp by injection molding, the reinforcement member 12 is securely placed in the mold first, by using a part of the mold that corresponds to the processing slot 121 to pass through a corresponding through slot (also designated by reference symbol 121 in FIGS. 1A and 1C) in the reinforcement member 12 to secure the reinforcement member to the mold, before introducing the plastic material into the mold. As a result, in the formed sliding block 1, the processing slot 121 is aligned with the through slot of the reinforcement member 12. By this method, the reinforcement member 12 is formed integrally with the respective protection ramp. In a preferred embodiment, the entire sliding block 1 including the one or two reinforcement members 12 is formed integrally by injection molding in the above-described manner.

In the embodiment illustrated in FIGS. 1A-1C, only the first protection ramp 111 is provided with the reinforcement member 12. In alternative embodiments, the second protection ramp 112, or both the first protection ramp 111 and the second protection ramp 112 may be provided corresponding reinforcement members. The reinforcement member is formed of a metal material or another hard, wear-resistant material.

In this embodiment, the areas of the first protection ramp 111 and/or the second protection ramp 112 that is covered by the respective reinforcement member 12 is the inclined surfaces of these ramps that face upwards (i.e. faces away from the bottom panel of the frame 3), which is the surfaces contacted by the prongs of the power plug when the plug is inserted.

Figure 3A:
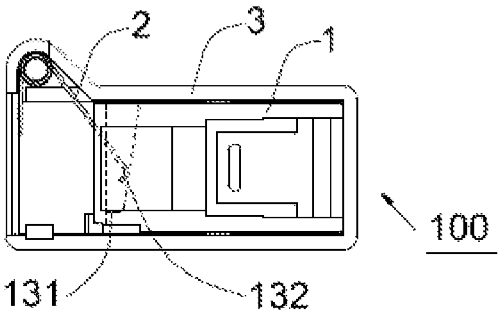
FIG. 3A is a plan view of the safety shield assembly in a closed state.
Figure 3B:
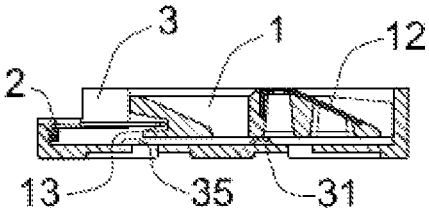
FIG. 3B is a cross-sectional view of the safety shield assembly shown in FIG. 3A.
Figure 4A:
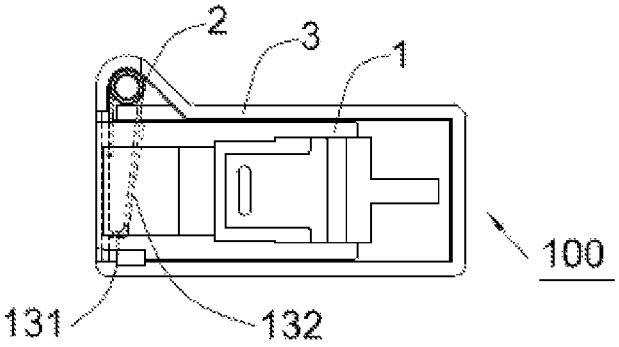
FIG. 4A is a plan view of the safety shield assembly in an open state.
Figure 4B:
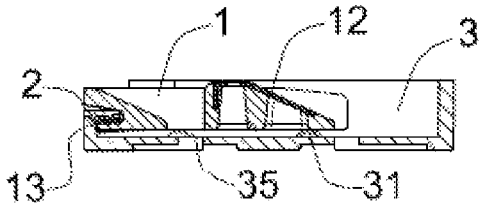
FIG. 4B is a cross-sectional view of the safety shield assembly shown in FIG. 4A.

In some embodiments, the balancing support member 31 is an elongated bump (also labeled 31) having a curved surface that protrudes from the inner bottom surface of the frame 3 (see FIGS. 2, 3B and 4B). The bump 31 is elongated in the direction perpendicular to the sliding direction of the sliding block 1. Preferably, the balancing support member 31 is located between the two openings 33 and 34 of the frame 3, and when the sliding block 1 is in the closed position, the balancing support member is located approximately at the center of the bottom surface of the sliding block 1. Thus, the bump 31 can balance the sliding block 1 on it and allow the sliding block to pivot with respect to the frame 3 as well as to slide along the frame. It can also reduce friction, thereby prolonging product life. It should be understood that the bump 31 may also be configured as a ridge, or a series of protruding dots that are spaced apart in the direction perpendicular to the sliding direction of the sliding block, or even a single relatively large protruding dot.

In some embodiment, the balancing support member 31 includes a pair of bumps disposed symmetrically on the bottom surface of the frame 3 and spaced apart from each other in the direction perpendicular to the sliding direction of the sliding block 1.

Figure 5B:
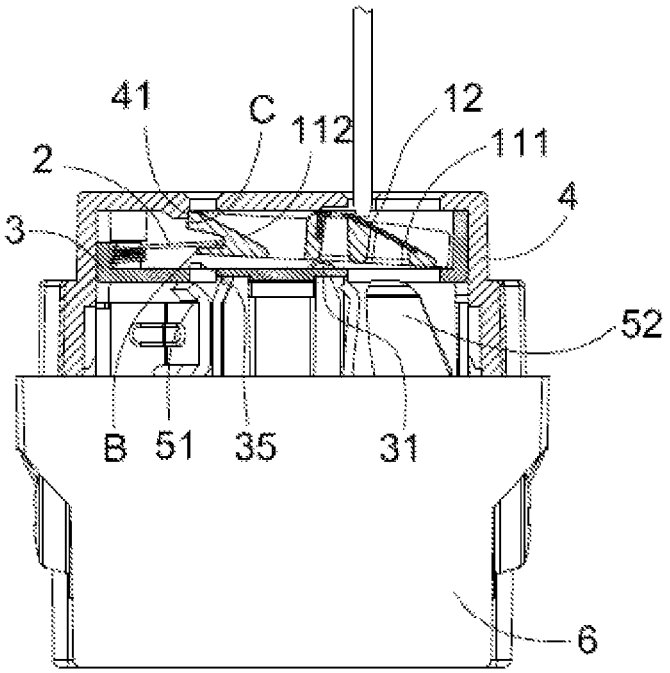
FIG. 5B is another cross-sectional view of the power receptacle equipped with the safety shield assembly in the protecting state, showing a foreign object being inserted in another one of the socket holes.
Figure 6A:
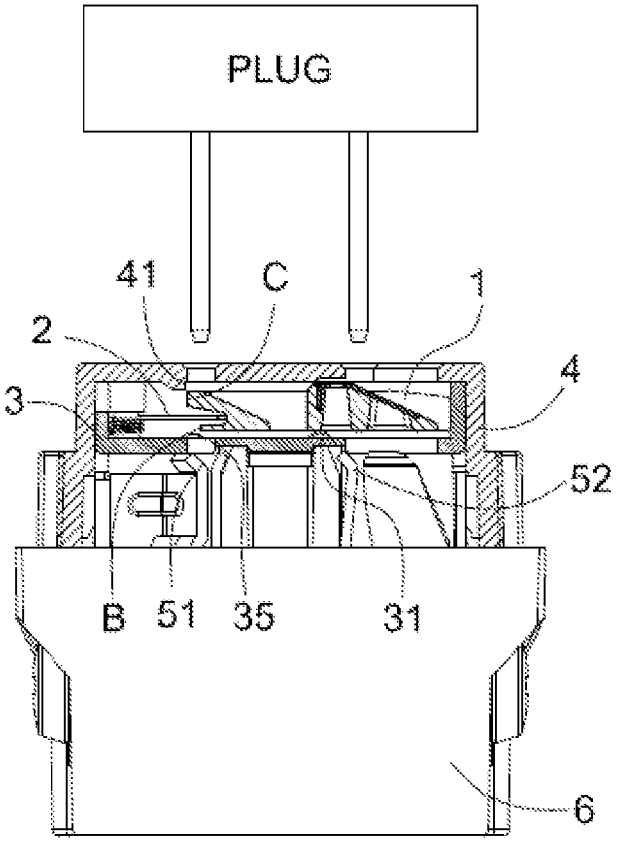
FIG. 6A is a cross-sectional view of the power receptacle equipped with the safety shield assembly in a normal working state, where the prongs of a plug are ready to be inserted into the power receptacle.

As shown in FIGS. 3B and 4B, the position limiting member 35 of the frame 3 includes a protruding block (also labeled 35) that protrudes from the inner bottom surface of the frame 3. The protruding block 35 may be a protruding cube, ridge or dot. Advantageously, the protruding block 35 is disposed near at least one of the openings 33 and 34 in the bottom of the frame 3. Alternatively, the protruding block 35 may protrude from the side wall of the frame 3. As shown in FIG. 1B, the sliding block 1 has a bottom surface A that faces, and is approximately parallel to, the inner bottom surface of the frame 3. The sliding block 1 has a first position limiting face B that is configured to abut the protruding block 35 under some conditions as described later. To achieve the goal of limiting the position of the sliding block 1, the power receptacle may be provided with a second position limiting protrusion 41, as shown in FIGS. 5B and 6A. Note that the second position limiting protrusion 41 may alternatively be provided on the frame 3 itself, such as a sideways protrusion from the sidewall of the frame 3. Advantageously, the second position limiting protrusion 41 is disposed near at least one of the openings 33 and 34. Correspondingly, the sliding block 1 has a second position limiting face C that is configured to abut the second position limiting protrusion 41 under some conditions, as described later.

Referring to FIGS. 1A, 2, and 3A to 4B, the resilient member 2 may be any of a pressure spring, tension spring, resilient plate, torsion spring, etc. A torsion spring is shown in the figures as an example. One end of the resilient member 2 abuts the sliding block 1, and the other end of it abuts a corresponding structure of the frame 3, such as the inner side surface of the frame 3. The frame 3 also has a retaining member 32 for retaining the resilient member 2, such as a protruding shaft that protrudes from the inner bottom surface or the inner side surface of the frame 3, or a receding slot on the inner bottom surface or the inner side surface of the frame. In the example of FIG. 2, a shaft 32 that protrudes from the inner bottom surface of the frame 3 serves as the retaining member. To simplify the structure and reduce the space occupied in the power receptacle, the sliding block 1 is provided with a retaining groove 13, located in the sliding block base 11 under the second protection ramp 112, to accommodate one end of the resilient member 2. The retaining groove 13 also facilitates the positioning and assembling of the sliding block and the resilient member. In some embodiment, the retaining groove 13 has a working surface 132 that drives the deformation of the resilient member 2, and a locking surface 131 that keeps the resilient member 2 in the deformed state. More specifically, referring to FIGS. 3A and 3B, when the resilient member 2 is in its initial state, i.e., when the sliding block 1 covers the openings in the frame (and hence the socket holes of the power receptacle), if the prongs of a plug is normally inserted, the end of the resilient member 2 that abuts the sliding block 1 becomes deformed as the sliding block 1 slides, and its position moves along the working surface 132 until it reaches the locking surface 131. At this time, the openings (and hence the socket holes) become exposed, so the prongs can be successfully inserted, as shown in FIGS. 4A and 4B.

As can be seen from the drawings, in some embodiments, the two protection ramps 111 and 112 of the sliding block 1 may be designed to have different sizes (but the same inclination angle), so the two inserted prongs have different amount of travel along the protection ramps. For example, the first protection ramp 111 is sized to suit the I shaped opening 23, while the second protection ramp 112 has a larger size to suit the T shaped opening 34. This allows the safety shield assembly to be used with power receptacles of different standard models, such as ANSI/NEMA WD6 standard models.

The operation of the safety shield assembly is described below with reference to FIGS. 5A to 6B.

The power receptacle is shown to include a body and plug receiving plates 51 and 52 disposed in the body. The body includes an upper cover 4 and a base 6 connected together. The safety shield assembly is disposed between the upper cover 4 and the plug receiving plates 51 and 52.

When no object is being inserted into the power receptacle, in the safety shield assembly, due to the action of the resilient member 2, the sliding block 1 is maintained in a motionless condition and does not tilt relative to the frame, and the safety shield assembly is in a closed state.

Figure 5A:
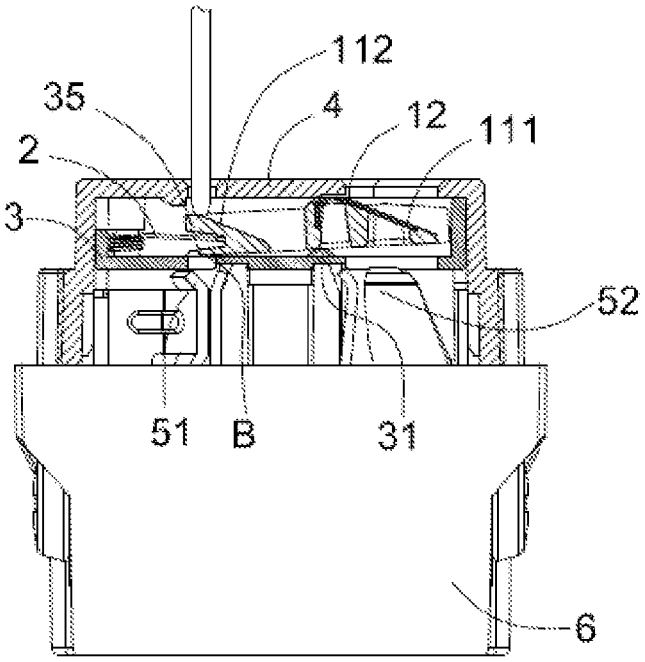
FIG. 5A is a cross-sectional view of a power receptacle equipped with the safety shield assembly in a protecting state, showing a foreign object being inserted in only one of the socket holes.

When an object is attempted to be inserted into only one of the socket holes of the power receptacle, for example into the hole on the left hand side as shown in FIG. 5A, the object contacts the second protection ramp 112 of the sliding block 1 and exerts a downward force on the second protection ramp 112. Due to the presence of the balancing support member 31, the right hand side of the sliding block 1 will be tilted upwards and the left hand side is tilted downwards, and the first position limiting face B on the left hand side of the sliding block 1 will be pushed against the protruding block of the frame 3. This limits the sliding motion of the sliding block 1, so as to prevent the object from being further inserted. Similarly, when an object is attempted to be inserted into only the socket hole on the right hand side as shown in FIG. 5B, the object exerts a downward force on the first protection ramp 111 of the sliding block 1. Thus, the left hand side of the sliding block 1 will be tilted upwards, and the second position limiting face C of the sliding block 1 will be pushed against the second position limiting protrusion 41 on the body of the power receptacle. This again limits the sliding motion of the sliding block 1, so as to prevent the object from being further inserted. This way, the safety shield assembly protects against insertion by an object into a single hole of the power receptacle.

Figure 6B:
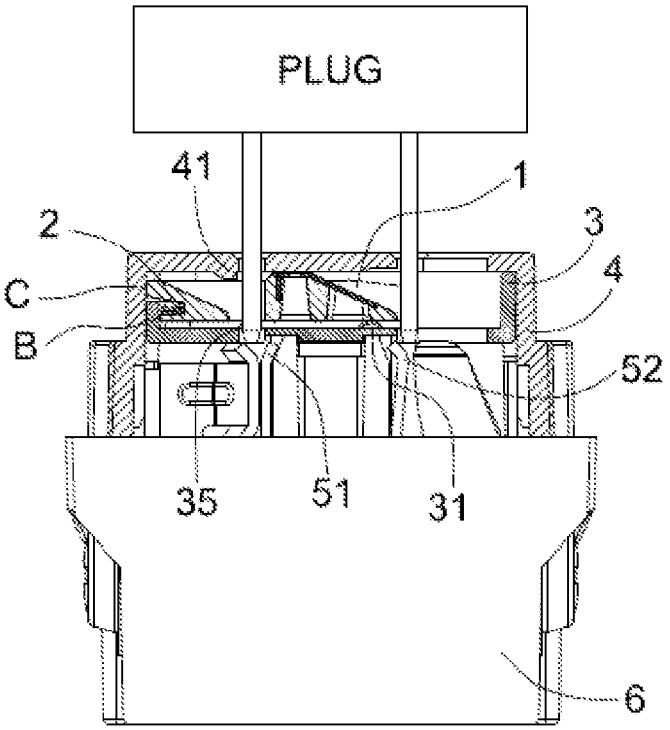
FIG. 6B is a cross-sectional view of the power receptacle equipped with the safety shield assembly in the normal working state, where the prongs of the plug are normally inserted into the power receptacle.

As mentioned earlier, the safety shield assembly according to embodiments of the present invention is suitable for various power receptacles complying with the ANSI/NEMA WD6 standard, such as 1-15P, 5-15P, 5-20P, 6-15P, 6-20P, etc. When a plug complying with the standard, for example, an NEMA 15A plug shown in FIGS. 6A and 6B, is attempted to be inserted, with the two prongs of the plug simultaneously inserted into the two holes of the upper cover 4, due to the balancing effect of the balancing support member 31, the sliding block 1 will not tilt with respect to the frame 3. Thus, the downward force exerted on the first protection ramp 111 and second protection ramp 112 of the sliding block 1 causes the sliding block 1 to slide along the frame 3 against the spring force of the resilient member 2, thereby exposing the socket holes to allow the prongs to be properly inserted. The prongs contact the plug receiving plates 51 and 52 to establish electrical connection. It should be noted that when the plug is removed from the power receptacle, due to the spring force of the resilient member 2, the sliding block 1 will slide back to its closed position and will continue to perform the protection function.

Figure 7:
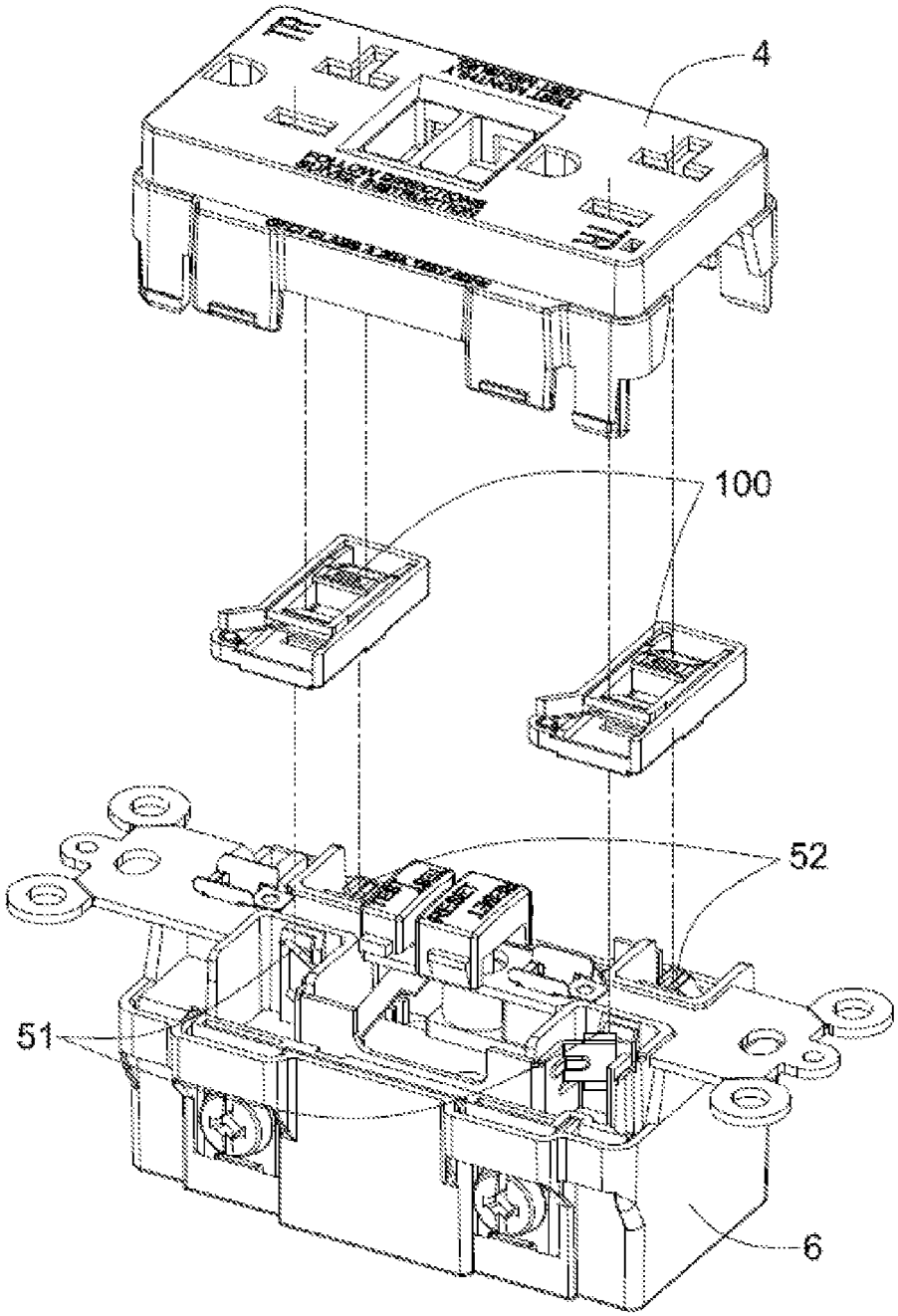
FIG. 7 is an exploded view of a power receptacle incorporating a safety shield assembly according to an embodiment of the present invention.

FIG. 7 illustrates the structures of a number of power receptacles that incorporate the safety shield assembly according to embodiments of the present invention. The power receptacle shown in FIG. 7 is similar to those shown in FIGS. 6A-6B, and includes two safety shield assemblies 100. Because the safety shield assembly has a compact and simple structure, the overall size of the power receptacle does not significantly increase when the safety shield assembly is incorporated. Thus, the safety shield assembly can have wide applicability. Moreover, because the safety shield assembly has relatively few components, and the various components can limit the position of each other, the assembling process is easy to automate.

The power receptacle may include a leakage current protection assembly, which may be any suitable leakage current protection assembly known in the art.

It should be appreciated that the embodiments in FIGS. 1A to 7 only show some possible shapes, sizes and spatial arrangements of the components of the safety shield assembly and power receptacle of the present invention. These illustrations are not limiting. Other shapes, sizes and spatial arrangements may be used without departing from the spirit of the present invention. Further, the frame and sliding block of the above described safety shield assembly are respectively shown as integral pieces, which is convenient for processing and assembly; however, they may also be separate pieces or partly integrated and partly separate, depending on the number of the socket holes.

It will be apparent to those skilled in the art that various modification and variations can be made in the safety shield assembly and power receptacle and related assembling method of the present invention without departing from the spirit or scope of the invention. Thus, it is intended that the present invention cover modifications and variations that come within the scope of the appended claims and their equivalents.

What is claimed is:

1. A safety shield assembly for a power receptacle, comprising:

a frame;

a sliding block disposed in the frame, including:

a sliding block base;

a first protection ramp disposed in the sliding block base;

a second protection ramp disposed in the sliding block base and spaced apart from the first protection ramp; and at least one reinforcement member, joined to the first protection ramp or the second protection ramp; and a resilient member disposed in the frame;

wherein the frame includes a bottom panel with at least two openings corresponding to at least two socket holes of the power receptacle, a position limiting member configured to abut the sliding block, and a balancing support member, wherein when the resilient member is in its initial state, it urges the sliding block to a closed position where the sliding block covers the at least two openings, wherein when an inserted object pushes on only one of the first protection ramp and the second protection ramp, the position limiting member limits a sliding motion of the sliding block, and wherein when two inserted objects simultaneously push on the first protection ramp and the second protection ramp, the sliding block is balanced on the balancing support member and slides along the frame to expose the at least two openings.

2. The safety shield assembly of claim 1, wherein the sliding block further includes:

a retaining groove located in the sliding block base under the second protection ramp, configured to receive one end of the resilient member; and at least one processing slot formed in the first protection ramp or the second protection ramp and aligned with a through slot of the reinforcement member.

3. The safety shield assembly of claim 2, wherein the retaining groove includes a working surface configured to drive deformation of the resilient member, and a locking surface configured to keep the resilient member in a deformed state.

4. The safety shield assembly of claim 1, wherein the sliding block includes:

two reinforcement members respectively joined to the first protection ramp and the second protection ramp; and a processing slot formed in each of the first protection ramp and the second protection ramp and aligned with a through slot of the respective one of the two reinforcement members.

5. The safety shield assembly of claim 1, wherein the at least one reinforcement member is formed of a metal material or another hard, wear-resistant material.

6. The safety shield assembly of claim 1, wherein the at least one reinforcement member covers an inclined area of the first protection ramp or the second protection ramp that faces away from the bottom panel of the frame.

7. The safety shield assembly of claim 1, wherein the first protection ramp and the second protection ramp have different sizes.

8. The safety shield assembly of claim 1, wherein the frame further includes a retaining member configured to retain the resilient member, the retaining member including either a protruding shaft that protrudes from the inner bottom surface or an inner side surface of the frame, or a receding slot on the inner bottom surface or the inner side surface of the frame.

9. A power receptacle, comprising:

at least one safety shield assembly of claim 1;

a body, including an upper cover and a base connected together; and at least two plug receiving plates disposed in the body, wherein the safety shield assembly is disposed between the upper cover and the at least two plug receiving plates.

10. The power receptacle of claim 9, further including a leakage current protection assembly.

11. The safety shield assembly of claim 1, wherein the balancing support member includes an elongated bump having a curved surface that protrudes from an inner bottom surface of the frame, wherein the bump is elongated in a direction perpendicular to a sliding direction of the sliding block, and wherein when the resilient member is in its initial state, the balancing support member is located near a center of a bottom surface of the sliding block.

12. The safety shield assembly of claim 1, wherein the balancing support member includes a pair of bumps disposed symmetrically on the bottom surface of the frame and spaced apart from each other in the direction perpendicular to the sliding direction of the sliding block.

13. The safety shield assembly of claim 1, wherein the position limiting member includes a protruding block that protrudes from an inner bottom surface of the frame, and wherein the sliding block includes a first position limiting face configured to abut the protruding block.

14. The safety shield assembly of claim 13, wherein the protruding block is disposed near at least one of the at least two openings of the frame.

15. The safety shield assembly of claim 13, wherein the sliding block includes a second position limiting face configured to abut a second position limiting protrusion on the power receptacle.

16. The safety shield assembly of claim 15, wherein the second position limiting protrusion is disposed near at least one of the at least two socket holes of the power receptacle.

17. The safety shield assembly of claim 1, wherein the resilient member includes a pressure spring, a tension spring, a resilient plate, or a torsion spring.

18. A safety shield assembly for a power receptacle, comprising:

a frame, having a bottom panel configured to define at least two openings;

a sliding block disposed in the frame, including:

a sliding block base;

a first protection ramp disposed in the sliding block base;

a second protection ramp disposed in the sliding block base and spaced apart from the first protection ramp, wherein the first and second protection ramps face away from the bottom panel of the frame and are located at positions corresponding to the at least two openings of the frame when the sliding block is at the closed position; and at least one reinforcement member, joined to the first protection ramp or the second protection ramp; and a resilient member disposed in the frame;

wherein the resilient member is configured to urge the sliding block toward a closed position, wherein when in the closed position, the sliding block covers the at least two openings of the frame, wherein the frame further includes a balancing support member located between the at least two openings and configured to pivotally support the sliding block, wherein the sliding block is configured to change from a first pivoting state to a second pivoting state in response to an external force exerted on only one of the first protection ramp and second protection ramp, and to remain in the first pivoting state in response to forces simultaneously exerted on both of the first protection ramp and second protection ramp, and wherein the frame further includes a position limiting member configured to restrict a sliding motion of the sliding block when the sliding block is at the closed position and in the second pivoting state, and to not restrict the sliding motion of the sliding block when the sliding block is in the first pivoting state.

19. The safety shield assembly of claim 18, wherein the sliding block includes:

two reinforcement members respectively joined to the first protection ramp and the second protection ramp; and a processing slot formed in each of the first protection ramp and the second protection ramp and aligned with a through slot of the respective one of the two reinforcement members.

20. A power receptacle, comprising:

at least one safety shield assembly of claim 18;

a body, including an upper cover and a base connected together, the upper cover including at least two socket holes; and at least two plug receiving plates disposed in the body below the at least two socket holes, respectively, wherein the safety shield assembly is disposed between the upper cover and the at least two plug receiving plates, and wherein the at least two openings of the frame correspond in position to the at least two socket holes of the upper cover of the body.

* * * * *